United States Patent [19]

Eller et al.

[11] Patent Number: 4,797,067

[45] Date of Patent: Jan. 10, 1989

[54] PUMPING SYSTEM WITH DESILTING ARRANGEMENT

[75] Inventors: J. David Eller, Deerfield Beach; Juan E. Ponce, Boca Raton, both of Fla.

[73] Assignee: M & W Pump Corporation, Deerfield Beach, Fla.

[21] Appl. No.: 107,273

[22] Filed: Oct. 13, 1987

[51] Int. Cl.[4] ..... E02F 3/88; F04B 49/00; F04B 49/10

[52] U.S. Cl. ..... 417/43; 417/42; 417/53; 417/430; 37/58

[58] Field of Search ..... 417/430, 405, 390, 279, 417/291, 300, 26, 28, 43, 47, 53; 415/11, 130, 152 A; 37/58

[56] References Cited

U.S. PATENT DOCUMENTS

| | | | |
|---|---|---|---|
| 2,431,995 | 12/1947 | Drescher et al. | 417/28 |
| 2,572,263 | 10/1951 | Hofer | 417/279 X |
| 2,582,556 | 1/1952 | Morey | 60/469 |
| 3,316,843 | 5/1967 | Vaughan | 417/430 |
| 3,890,065 | 6/1975 | Eller et al. | 417/360 |
| 3,907,463 | 9/1975 | Eller et al. | 417/360 |
| 3,910,728 | 10/1975 | Sloan | 417/405 X |
| 4,070,135 | 1/1978 | Eller | 37/58 X |

FOREIGN PATENT DOCUMENTS

| | | | |
|---|---|---|---|
| 201617 | 7/1983 | German Democratic Rep. | 37/58 |
| 115899 | 9/1981 | Japan | 415/130 |
| 233031 | 12/1984 | Japan | 37/58 |
| 190195 | 8/1986 | Japan | 415/11 |

*Primary Examiner*—William L. Freeh
*Attorney, Agent, or Firm*—Oltman and Flynn

[57] ABSTRACT

Pumping system with a desilting arrangement having a bidirectional water pump disposed in a housing which has a pump inlet and a pump outlet. The system also has a silt blow-out pipe with a desilting valve therein, connected at one end to the pump outlet and having the other end spaced a certain distance away from the pump inlet and below the water level. Desilting is performed by opening the desilting valve and operating the pump in reverse direction for blowing silt, accumulated at the pump outlet, away.

16 Claims, 3 Drawing Sheets

PUMPING SYSTEM WITH DESILTING ARRANGEMENT

BACKGROUND AND PRIOR ART

This invention relates to pumping systems, and more particularly to pumping systems in water control installations where there is a siltation problem.

In water management and control systems as widely used for moving large amounts of water in connection with dams, locks, irrigations systems and other water-flow controlling installations, it frequently happens that the pump sump inlet below the water surface becomes clogged with silt and mud, which in severe cases may completely disable the pumping system. This often happens after periods of heavy rains and presents a difficult problem in the operation of such systems.

SUMMARY OF THE INVENTION

In order to overcome the silting problem described hereinabove, a pumping system is provided which has a bidirectional or reversible water pump, i.e. a water pump capable of selectively pumping water in either direction through the pump. The pump is disposed in a pump housing which has an inlet and an outlet for the water in the normal pumping direction, but change respectively to outlets and inlets when the pump is reversed. A pump of this type is described in U.S. Pat. No. 3,907,463. A silt blow-out pipe is connected at one end to the pump outlet and a desilting valve is inserted in the blow-out pipe. The other end of the blow-out pipe is positioned at some suitable distance away from the pump inlet, so that the silt is transported away from the pumping area, when the pump is running in the forward normal direction with the desilting valve open.

In normal desilting operation, wherein the silt accumulation is not too severe, desilting is accomplished by starting the pump in the normal flow direction and opening the desilting valve. In this operation water mixed with silt and mud is expelled through the silt blow-out pipe so that the blow-out pipe is cleared of silt. In a severe silting condition the silt may be packed around the pump inlet and filling the pump housing so that the entire pump is almost inoperative. Under such a condition, the silt is cleared by operating the pump in the reverse direction and opening the desilting valve in the silt blow-out pipe, thereby causing water to be drawn in through the blow-out pipe and out though the pump inlets. This reverse operation is able to desilt the pump under even severely silted conditions. For maximum effect in the reverse operation the inlet of the blow-out pipe should be positioned at a distance sufficiently below the water level to draw adequate water and sufficiently above the bottom to avoid drawing debris from the bottom.

In accordance with a further feature of the invention, the desilting valve is a butterfly valve which allows a high flow of water without unduly impeding the water flow.

In accordance with still another feature, the pump is driven by a hydraulic motor that can be reversed either by means of a reversing valve which reverses the direction of fluid through the motor, or the motor may be any one of a number of well known types of reversible motors.

In accordance with still another feature the pump may be driven by a reversible electric motor.

In accordance with a still further feature the pump is an axial or mixed design flow having an impeller with reversible impeller blades, as is well known from reversible ships' propellers and aircraft propellers.

In accordance with still another feature, a water flow sensing device is placed in the pump outlet which is combined with remote control means that automatically activate the silt-clearing action, if the control means detect that no water is flowing in the pump outlet after the pump has been started.

Further objects and advantages of this invention will be apparent from the following detailed description of a presently preferred embodiment which is illustrated schematically in the accompanying drawings.

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

DESCRIPTION OF THE PREFERRED EMBODIMENTS

Figure 5:
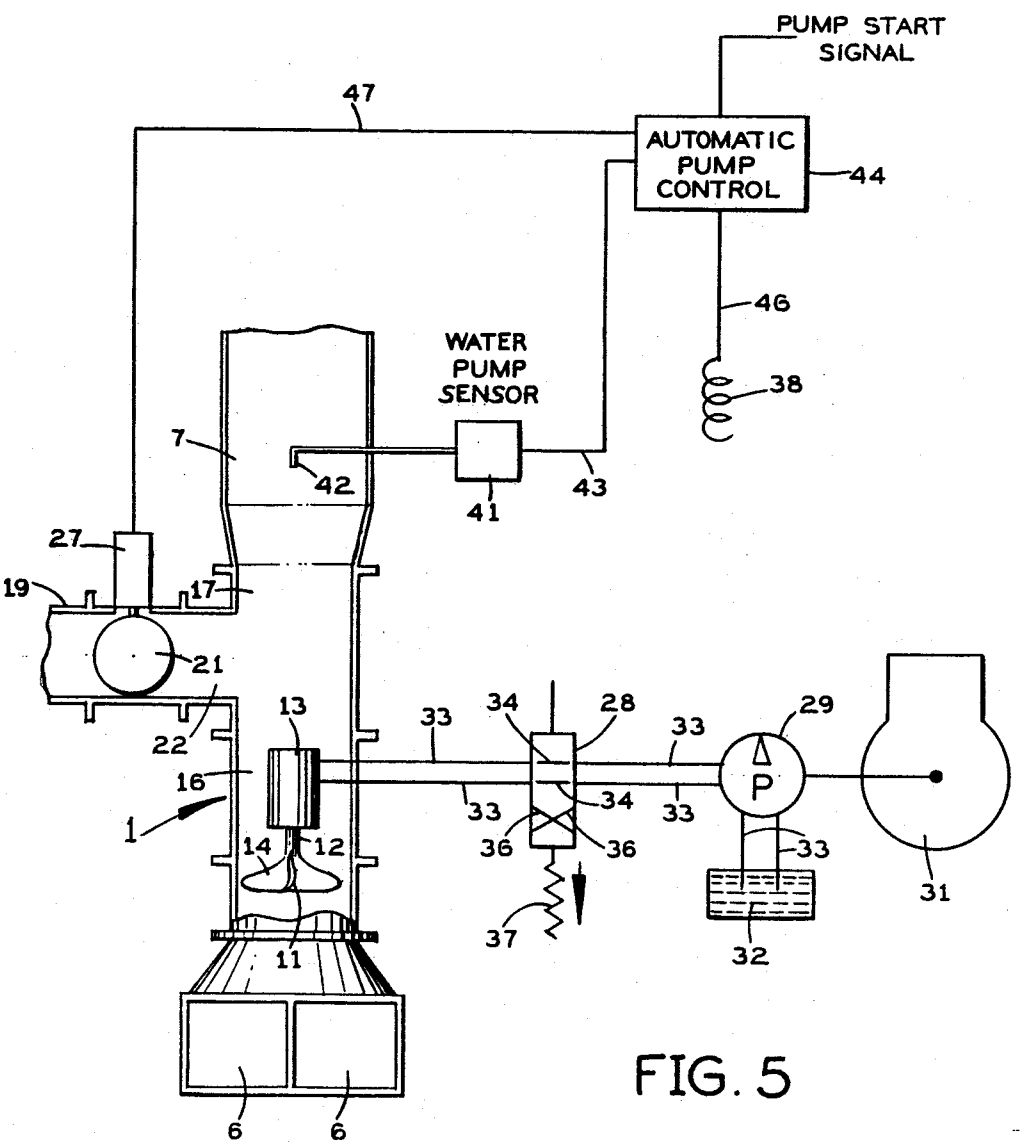
FIG. 5 is a diagrammatic cross-sectional fragmentary detail with part of the pump wall broken away to show the interior of the invention showing an impeller and control details.

In FIGS. 1–5 three pumping systems are seen with their pumps 1 mounted vertically in a water management system consisting of a lower part 2, and an upper part 3 separated by a dam 4. The pumps serve to raise the water from the lower part 2 to the upper part 3, drawing water through inlets 6, and raising it through the upstanding pipes 7 and the level pipes 8 through a flap valve 9 to the upper part 3. FIG. 5 shows in a cross-sectional view details of the pump 1, which includes the pump impeller 11, connected by a shaft 12 to a motor 13. The impeller 11 has a plurality of radially extending blades 14 and is rotatably mounted inside a pump housing 16, which is at its lower end connected to a plurality of water inlets 6 and at its upper end to an outlet 17 leading to the upper water part 3, through the pipes 7 and 8 as described above.

Structural elements, generally at 18 formed or reinforced concrete, steel or the like serve as retaining structures for the dam 4, the floor of the lower water part 2, and to support the pump 1 and the various pipes described above. These structures are not part of the invention concept.

Figure 2:
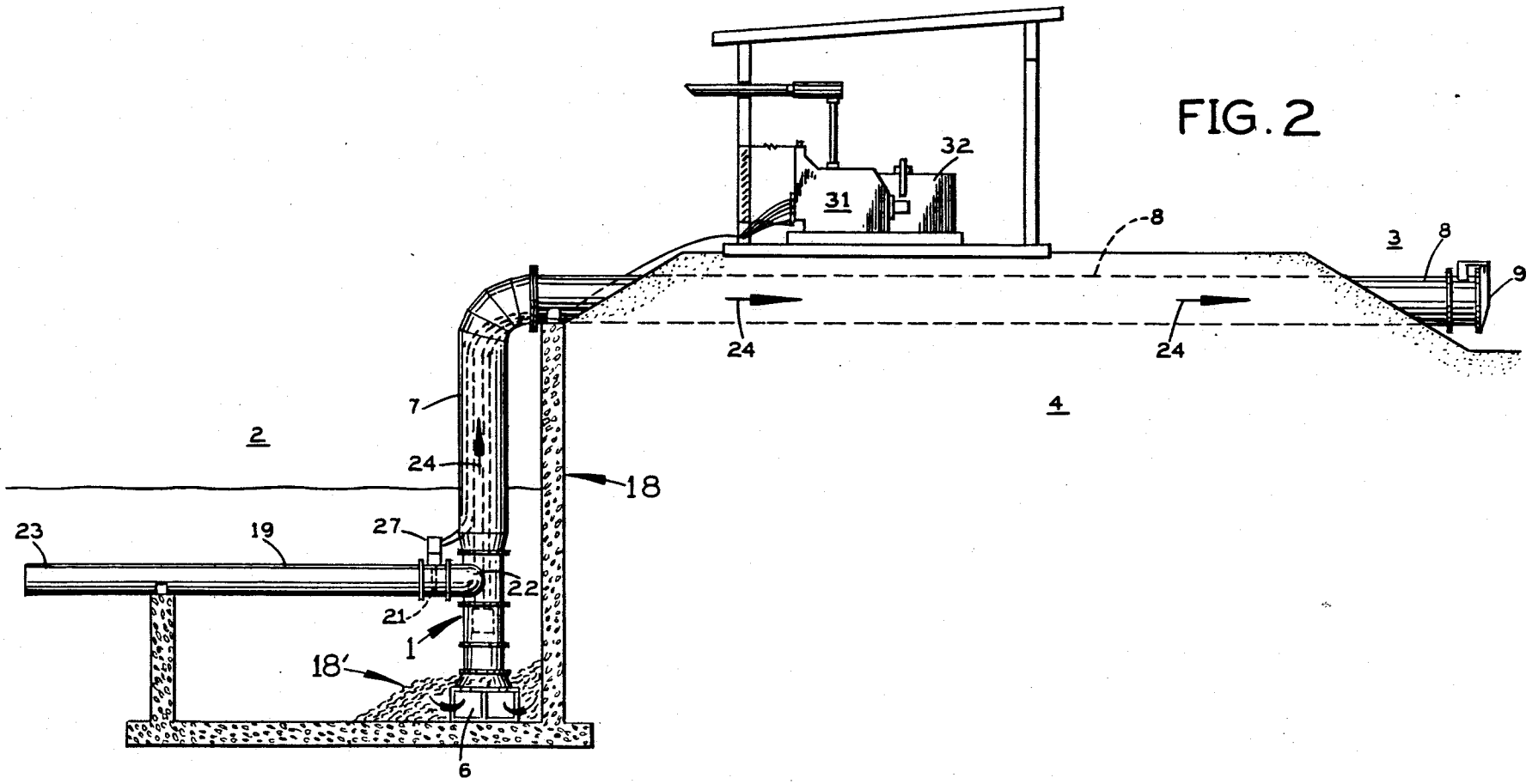
FIG. 2 is an elevational cross-sectional view of the invention showing an upper and a lower part of a pump system.
Figure 3:
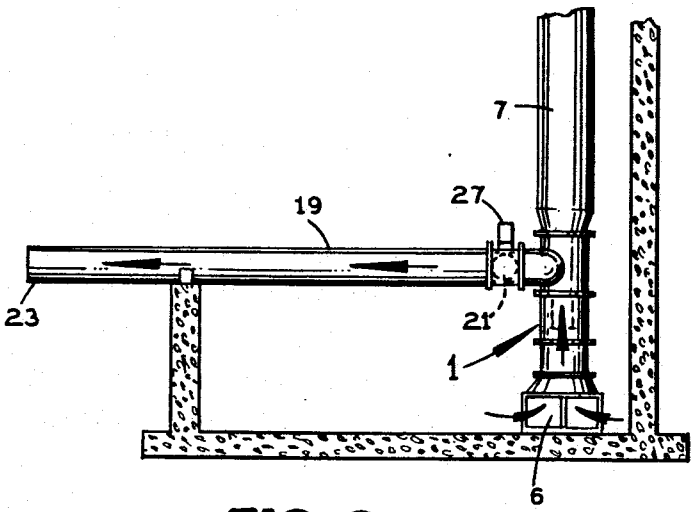
FIG. 3 is an elevational, diagrammatical, detailed view of the invention showing forward water flow through the silt blow-out pipe.
Figure 4:
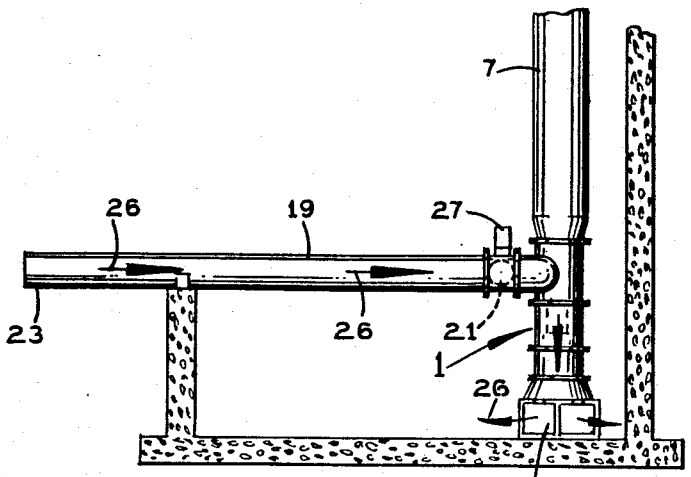
FIG. 4 is an elevational, diagrammatical, detailed view showing reverse water flow through the silt blow-out pipe and the pump.

In the case of a silting condition in the form of an accumulation of debris, mud and silt, shown generally at 18' in FIG. 2, which impedes the operation of the pumping system, the invention can be set in a desilting mode. For this purpose a silt blow-out pipe 19 is provided which has a near end 22 in fluid communication with the pump outlet 17 and a distal end 23 in fluid communication with the water in the lower water part 2. The silt blow-out pipe 19 has a valve 21, advantageously in the form of a butterfly valve 21, controlled by a valve motor 27. The valve motor may be a hydraulic or electric motor or any other suitable valve control device. The pump 1 is a bidirectional pump of known design, having a forward flow direction, in which water is drawn in through the inlets 6 and discharged through pipes 7 and 8 in the upper water part 3 as shown by the direction of the arrows 24. In a different mode, the silt blow-out-mode, the valve 21 is opened as the pump is driven in its forward direction, resulting in water flow as shown in FIG. 3, wherein water is drawn in through the inlets 6 and discharged through the silt blow-out pipe 19, thereby drawing out the accumulated silt and debris 18' and discharging it from the distal end 23 of the pipe 19.

In a severly silted condition the silt and debris 18' may be so tightly packed around the inlets 6 that the waterflow is completely stopped. In this case, the pump is reversed so that the direction of flow is reversed, as shown by arrows 26 in FIG. 4. In this case water is drawn in from the distal end 23 of the pipe 19 through the open valve 21 and discharged through the inlets 6, causing the debris 18' to be scattered and blown away from the pump inlet 6, so that normal pumping operation can be commenced.

Reversing the pumping direction can be accomplished by reversing the pump motor 13, or by reversing the impeller blades of the bidirectional pump 1 in a manner known to those skilled in the art.

As described above the pump motor 13 and also the valve control motor 27 may advantageously be hydraulic motors. Hydraulic motors, as is well known, are available in a number of forms, such as gearwheel motors, also known as gerotors, piston motors and others. In FIG. 5 a reversing arrangement is shown, which has a reversing valve 28, a hydraulic pump 27 driven by an engine 31, e.g. in the form of a diesel engine, and a hydraulic fluid tank, connected by pipes 33 with the reversing valve 28 and the hydraulic motor 13. The valve 28 has a valve spool with straight channels 34 and reverse channels 36. A valve spring 37 maintains the valve 28 in the forward direction and a solenoid 38, which when activated by the pump control, overcomes the force of the valve spring 37 and moves the valve spool to its upper position with the reverse channels 36 in place of the straight channels 34, causing the flow of hydraulic fluid to the motor 13 to be reversed, which in turn causes the motor to reverse direction.

Figure 1:
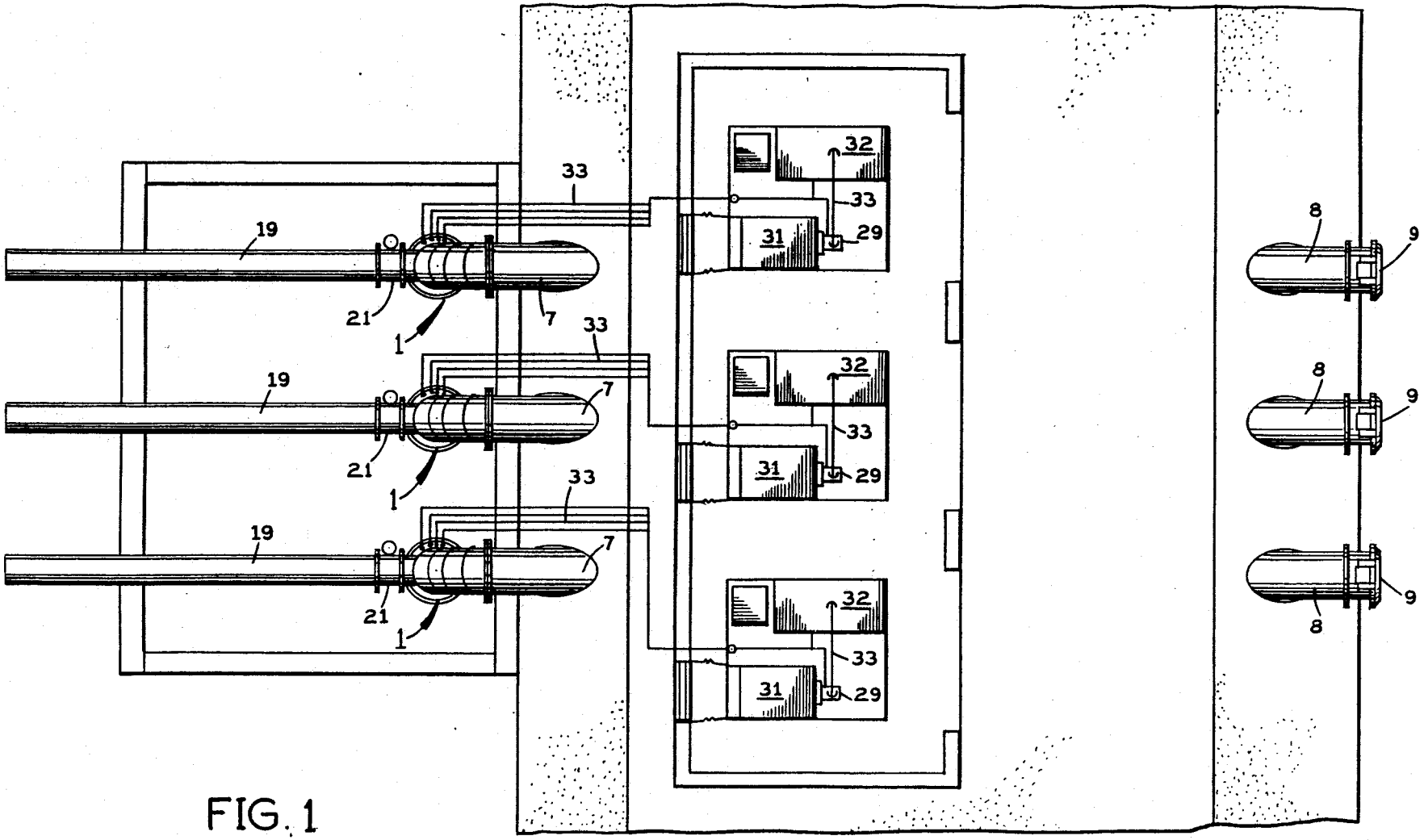
FIG. 1 is a plan view of the invention showing three pumps with associated power elements.

FIGS. 1 and 2 show an engine 31 for each pumping system, connected to the respective hydraulic pump 29, in turn connected to the hydraulic fluid tank 32.

A water flow sensor 41 is connected to a pitot tube 42 in the flow discharge pipe 7 so that it can sense the presence of water flow in the pipe. The sensor 41 is connected via connection to an automatic pump control 44. Upon receiving a pump start signal, the automatic pump control 44 anticipates after a certain delay to receive a water flow signal from the sensor 41. In case the anticipated water flow signal is not received, the pump control 44 may issue a desilting signal on lead 46, which will reverse the motor 13 via control valve 28 and a butterfly valve open signal on lead 47 so that the desilting mode may be in operation for a given length of time, after which the automatic control will revert to normal pumping operation.

Having described the presently preferred embodiments of the invention, it should be understood that various changes in the construction and arrangement will be apparent to those skilled in the art and are fully contemplated herein without departing from the true spirit of the invention. Accordingly, there is covered all alternatives, modifications and equivalents as may be included within the spirit and scope of the invention as defined in the appended claims.

I claim:

1. Pumping system with desilting arrangement comprising: a bidirectional water pump, being operable in the forward and the reverse direction; a pump housing for containing the pump, having a pump inlet at one end and a pump outlet at the other end; a silt blow-out pipe in fluid communication with the pump outlet, having a desilting valve therein; a water discharge pipe containing a flow sensor, both being in fluid communication with the pump outlet; a pump drive means connected to the pump; and means to direct both operation of the pump in a reverse direction and the desilting valve responsive to an absence of a water flow signal from the flow sensor, for the purpose of blowing out any silt in the pump inlet.

2. Pumping system according to claim 1 wherein the means to direct further comprises an automatic pump control being responsive to a pump start signal and the absence of the water flow signal from the flow sensor to operate the pump in the reverse direction combined with the opening of the desilting valve.

3. Pumping system according to claim 1 wherein said desilting valve is a butterfly valve.

4. Pumping system according to claim 1 wherein said pump is an axial or mixed flow pump having an impeller mounted on a shaft, and said pump housing is cylindrical with the pump shaft disposed coaxially inside the housing.

5. Pumping system according to claim 1 wherein said pump drive means include a hydraulic motor.

6. Pumping system according to claim 5 including motor reversing means for reversing the direction of rotation of said hydraulic motor.

7. Pumping system according to claim 5, including a reversing hydraulic valve in fluid communication with said motor for reversing the direction of fluid flow to the motor.

8. Pumping system according to claim 1 wherein said silt blow-out pipe has a distal end being disposed below the water level.

9. Pumping system according to claim 8 wherein said distal end is spaced apart at least four feet from said pump inlet.

10. Method for desilting a pumping system having a bidirectional water pump, having a pump inlet and a pump outlet; a waterflow sensor and a silt blow-out pipe connected to the pump outlet, having a desilting valve therein; comprising the steps of responding to an absence of a waterflow signal from the waterflow sensor by opening the desilting valve; and by operating the pump in the reverse direction.

11. Pump system with desilting arrangement comprising:

a reversible pump;

a pump drive means connected to the pump;

a pump inlet in fluid communication with the pump;

a pump outlet in fluid communication with the pump;

a silt blow-out pipe in fluid communication with the pump outlet;

a desilting valve disposed within the silt blow-out pipe; and a flow sensor in fluid communication with the pump outlet and in signal communication with both a pump reversing means and the desilting valve to open said valve and reverse the pump responsive to an absence of a flow signal from the flow sensor, whereby any silt in the pump inlet may be blown out by reverse flow using fluid obtained through the opened desilting valve and silt blow-out pipe.

12. Pumping system according to claim 11 wherein said desilting valve is a butterfly valve.

13. Pumping system according to claim 11 wherein said pump is an axial or mixed flow pump having an impeller mounted on a shaft, and said pump includes a housing which is cylindrical, the pump shaft being disposed coaxially inside said housing.

14. Pumping system according to claim 11 wherein said pump drive means includes a hydraulic motor.

15. Pumping system according to claim 14 including motor reversing means for reversing the direction of rotation of said hydraulic motor.

16. Pumping system with desilting arrangement comprising:

a bidirectional water pump, being operable in the forward and the reverse direction;

a pump housing for containing the pump, having a pump inlet at one end and a pump outlet at the other end;

a silt blow-out pipe in fluid communication with the pump outlet, having a desilting valve therein;

a water discharge pipe in fluid communication with the pump outlet;

a pump drive means connected to the pump;

a water flow sensor disposed in the pump outlet;

and an automatic pump control being responsive to a pump start signal the absence of a water-flow signal from the flow sensor to operate the pump in the reverse direction combined with opening of the desilting valve so as to blow out any silt in the pump inlet.

* * * * *